United States Patent [19]

Sprecher

[11] 3,961,504

[45] June 8, 1976

[54] VEHICULAR TRUNK LID LATCH ASSEMBLY

[75] Inventor: Raymond G. Sprecher, Detroit, Mich.

[73] Assignee: General Motors Corporation, Detroit, Mich.

[22] Filed: Apr. 3, 1975

[21] Appl. No.: 564,619

[52] U.S. Cl. ..... 70/1.5; 70/418; 70/419; 70/422; 292/DIG. 43

[51] Int. Cl.[2] ..... E05B 63/00

[58] Field of Search ..... 70/455, 423, 422, 419, 70/418, 1.5, 416; 292/216, DIG. 43

[56] References Cited

UNITED STATES PATENTS

| | | | |
|---|---|---|---|
| 1,188,846 | 6/1916 | Segal | 70/422 |
| 1,398,642 | 11/1921 | Lewis | 70/1.5 |
| 1,764,898 | 6/1930 | Segal | 70/1.5 |
| 1,904,882 | 4/1933 | Prior | 70/423 X |
| 2,042,026 | 5/1936 | Schoorel | 70/422 |
| 2,228,971 | 1/1941 | Pankratz | 70/1.5 |
| 2,942,449 | 6/1960 | White | 70/1.5 |
| 3,041,866 | 7/1962 | Segal | 70/1.5 |
| 3,047,325 | 7/1962 | DeVito | 292/216 X |
| 3,783,655 | 1/1974 | Giannetto | 70/1.5 |
| 3,881,330 | 5/1975 | Hester | 70/422 X |

FOREIGN PATENTS OR APPLICATIONS

| | | | |
|---|---|---|---|
| 1,072,507 | 12/1959 | Germany | 292/216 |

*Primary Examiner*—Roy D. Frazier
*Assistant Examiner*—Rodney H. Bonck
*Attorney, Agent, or Firm*—John P. Moran

[57] ABSTRACT

An automotive trunk lid latch assembly including a housing, a pair of latching members and a cam member, each rotatably mounted in the housing, a shaft extending into the housing from a lock cylinder assembly and adapted to rotate the cam member in response to manual rotation of a key in the lock cylinder assembly, and a spring-loaded lever rotatably mounted intermediate the cam member and one of the latching members and retained therebetween by the end of the shaft, and adapted to be rotated by the cam member to, in turn, unlatch the latching members. In the event of removal of the shaft, the spring-loaded lever will snap away from the cam member into an inoperable position, thus preventing any unlatching operation thereafter by the insertion of a probe or a screwdriver to rotate the cam member.

4 Claims, 4 Drawing Figures

VEHICULAR TRUNK LID LATCH ASSEMBLY

This invention relates generally to latch assemblies and, more specifically, to a latch assembly which is rendered inoperative upon removal of an adjacent lock cylinder assembly.

It has been determined by an element of our society that automotive trunks have been accessible by knocking out or otherwise removing the lock cylinder assembly from the trunk lid, along with the shaft which extends from the lock cylinder into the typical latch assembly, and then merely inserting a screwdriver or probe of some kind into the latch assembly in place of the shaft to unlatch the latched components.

Accordingly, a general object of the invention is to provide an improved vehicular latch assembly which is rendered inoperative upon removal of an adjacent lock cylinder assembly.

Another object of the invention is to provide an improved trunk lid latch arrangement which retains the advantageous features of the typical present-day latch assembly consisting of cam and latching components, but which includes, additionally, a spring-loaded lever rotatably mounted intermediate cam and latching components, which are conventional except for being spaced apart so as to be out of the range of contact with one another, with such intermediate lever being retained therebetween by an end portion of the shaft extending from the lock cylinder assembly and serving as an extension of the cam for operatively contacting an adjacent latching component. However, in the event of removal of the lock cylinder assembly and the shaft extending therefrom, the spring-loaded lever will snap away from its intermediate position into an inoperable position, i.e., into a position wherein it cannot be contacted by the cam, thus preventing the remotely located latched components from being unlatched by any manual rotation of the cam by a screwdriver or other type of probe or tool.

A further object of the invention is to provide an improved automotive trunk lid latch assembly including a housing mounted on an inner wall of the trunk lid, a cam member having a rectangular opening formed therein, a shaft operatively connected between the rectangular opening and a lock cylinder assembly mounted on an outer wall of the trunk lid, first and second pivotable levers mounted on a first pivot pin secured to a wall of the housing, the first lever being a first latching lever, a first spring member mounted on the first pivot pin and operatively connected between the first and second levers for urging the first and second levers in opposite rotational directions, a cam surface formed on the second lever for at times being engaged by the cam member, an extension formed on the first lever for being engaged by a surface of the second lever in response to camming action between the cam member and the cam surface on the second lever, a second latching lever pivotally mounted on a second pivot pin secured to a wall of the housing, respective cooperating latching surfaces formed on the first and second latching levers, a second spring member mounted on the second pivot pin and operatively connected between the first and second latching levers for urging the first and second latching levers apart once the latching surfaces are caused to separate in response to the camming action between the cam member and the cam surface on the second lever, and the resultant action on the adjacent first latching lever.

These and other objects and advantages of the invention will be apparent when reference is made to the following description and accompanying drawings, wherein.

Figure 1:
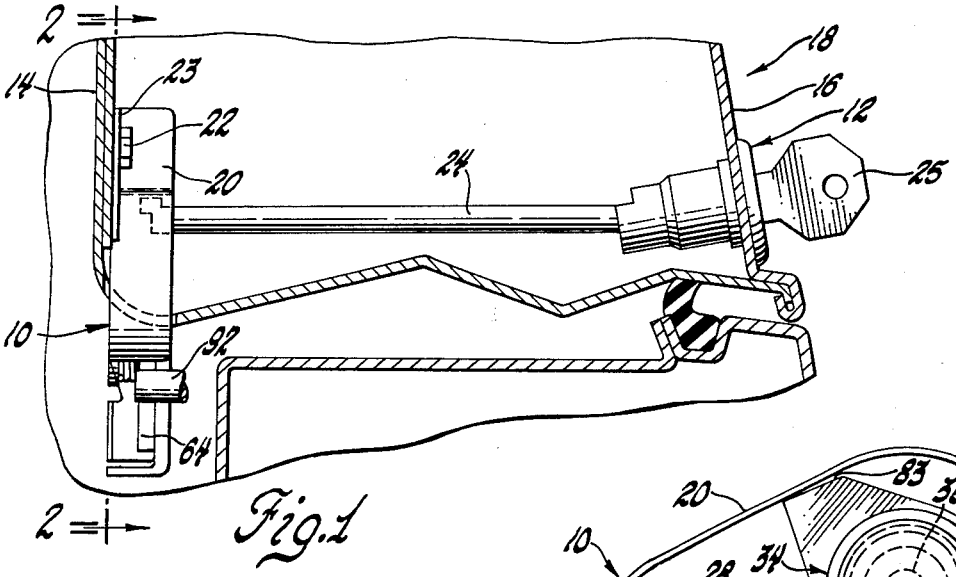
FIG. 1 is a fragmentary cross-sectional view of an automotive trunk lid embodying the invention.

Referring now to the drawings in greater detail, FIG. 1 illustrates a latch assembly 10 and a lock cylinder assembly 12 mounted respectively on an inner wall 14 and an outer wall 16 of an automotive trunk lid 18. The latch assembly 10 includes a housing 20 secured in any suitable manner, such as by bolts 22 through mounting brackets 23, to the wall 14. A shaft 24 is operatively connected between the housing 20 and the lock cylinder assembly 12, serving to transfer rotation by a key 25 of components of the latter to components of the latch assembly 10 in a manner to be described. The housing 20 includes a main wall 26 and a peripheral wall 27 formed therearound.

Figure 2:
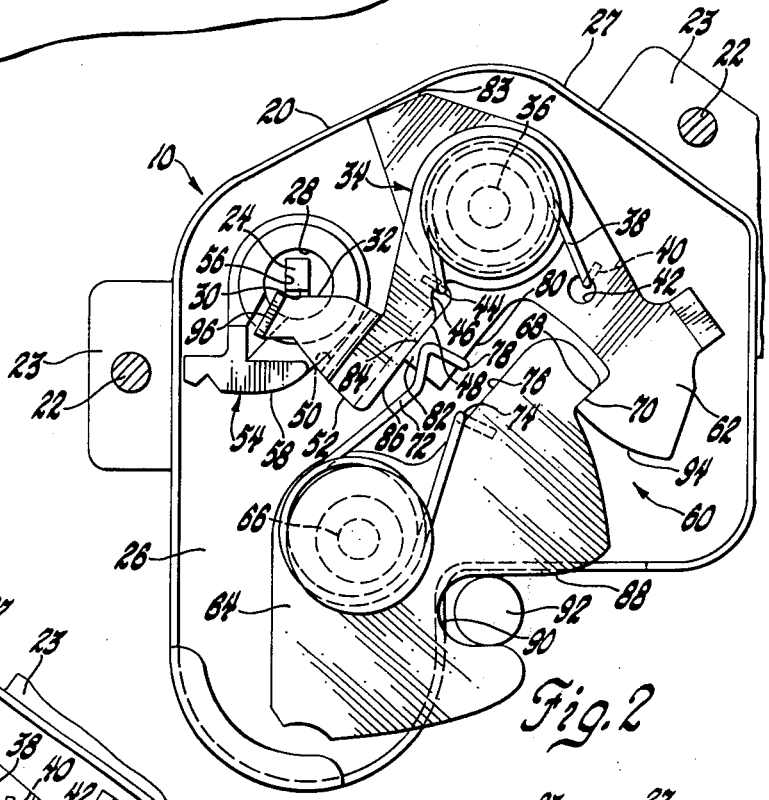
FIG. 2 is an end view taken along the plane of line 2—2 of FIG. 1, and looking in the direction of the arrows.
Figure 3:
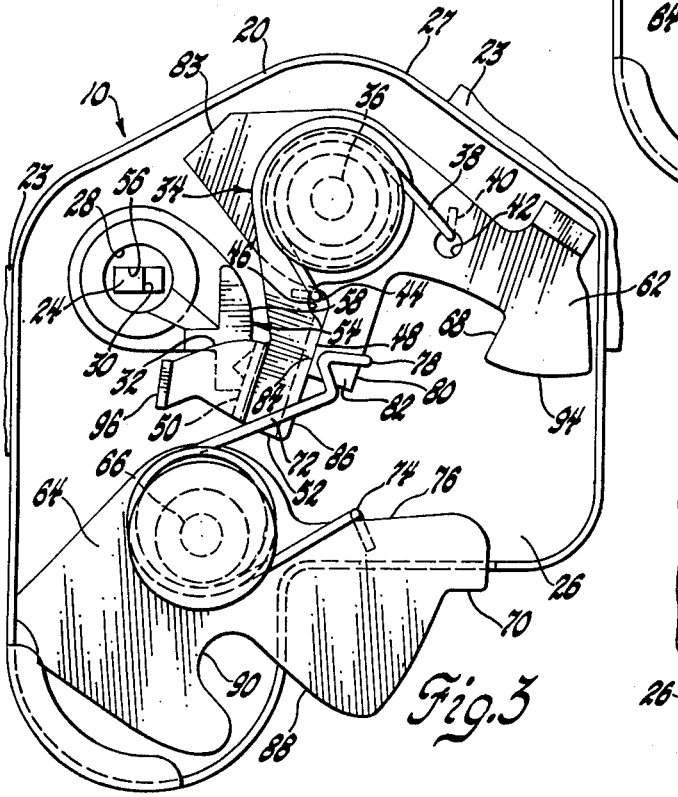
FIG. 3 is a view similar to that of FIG. 2, with components thereof shown in a different operational relationship.

As illustrated in FIG. 2, the shaft 24 extends through an opening 28 formed in the housing 20 so as to abut at an edge 30 thereof against an edge 32 of a camming lever or lever member 34 when the latch assembly 10 is in its normally latched position, i.e., with the trunk lid 18 closed.

The lever member 34 is pivotally mounted on a pivot pin 36 secured to the housing 20. A coil spring 38 is mounted around the pivot pin 36 and includes a first hook-like configuration 40 formed on one end thereof for engagement with a suitable opening 42 formed within the housing 20, and a second hook-like configuration 44 formed on the other end thereof for engagement with a notch 46 formed on an edge 48 of the lever member 34. A cam surface 50 is formed adjacent the end 52 of the lever member 34 perpendicular to the main wall 26 of the housing 20.

A cam member 54, including a rectangular opening 56 for insertion therethrough of the shaft 24, is pivotally mounted on the main wall 26 of the housing 20 and located so as to have a cam surface 58 thereof positioned adjacent the cam surface 50 of the lever member 34 when the latch assembly 10 is in its normally locked or latched position, as shown in FIG. 2.

A latching portion 60 includes a first latching lever 62 pivotally mounted on the pivot pin 36, and a second latching lever 64 pivotally mounted on a pivot pin 66 secured to the main wall 26 of the housing 20. The opening 42 for the spring end 40 may be formed in the lever 62. Latching edges 68 and 70 are formed on respective end portions of the first and second latching levers 62 and 64, respectively, for abutting engagement therebetween, as illustrated in FIG. 2, when the latch assembly 10 is in its normally locked position. A coil spring 72 is mounted around the pivot pin 66 and includes a first hook-like configuration 74 formed on one extended end thereof for engagement with an edge 76 of the second latching lever 64, and a second hook-like configuration 78 formed on the other extended end thereof for engagement with an edge 80 formed on an extension 82 of the first latching lever 62. This forces an end surface 83 (FIG. 2) of the first latching lever 62 into contact with the peripheral wall 27 of the housing 20. An edge 84 is formed on the extension 82 opposite the edge 80 and adapted to be contacted by a surface 86 formed on the lever member 34 opposite the cam surface 50 thereof. An abutment surface 88 is formed along a predetermined edge of the second latching lever 64 adjacent a notch 90 formed thereon, for cooperation with a rod-like striker member 92 secured permanently to the automotive body [not shown].

Operation

As indicated above, FIG. 2 illustrates the normally latched or locked position of the latch assembly 10 when the trunk lid 18 is in its closed or locked position. In order to unlock the trunk lid 18, the key 25 is manually rotated in a normal clockwise direction as viewed from a position to the right in FIG. 1, producing a counterclockwise directional movement of the shaft 24 as viewed in FIG. 2. Such counterclockwise movement of the shaft 24 serves to rotate the cam member 54, bringing the cam surface 58 thereof into contact with the cam surface 50 of the lever member 34, resulting in a counterclockwise movement of the lever member 34 about the pivot pin 36. Such counterclockwise movement of the lever member 34 causes the surface 86 of the lever member 34 to abut against the edge 84 of the extension 82 of the first latching lever 62, and causes the latter lever to rotate in a counterclockwise direction about the pivot pin 36, against the force of the hooked end 78 of the spring 72. Such counterclockwise rotation of the first latching lever 62, in turn, causes the edge 68 of the first latching lever 62 to pull away from the edge 70 of the second latching lever 64, freeing the latter for a sudden unlatching clockwise directional movement about the pivot pin 66, under the force of the hooked end 74 of the spring 72.

As the trunk lid 18 is closed, the abutment surface 88 of the second latching lever 64 is brought into engagement with the fixed striker member 92. Continued downward movement of the trunk lid 18 causes the striker member 92 to force the second latching lever 64 into a counterclockwise directional movement until the notch 90 engages the striker member 92, at which point the latching edge 70 of the second latching lever 64 will have cammed past an abutment surface 94 formed along a predetermined edge of the first latching lever 62, permitting the latching edge 68 of the first latching lever 62 to once again be brought into locking engagement with the latching edge 70 of the second latching lever 64 under the force of the hooked end 78 of the spring 72.

Figure 4:
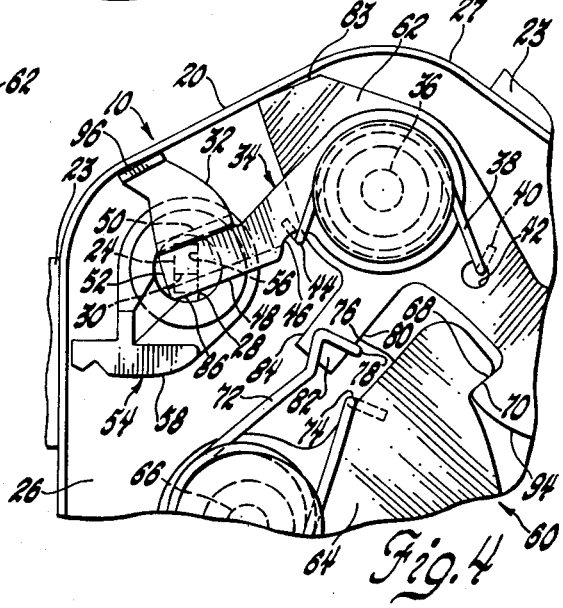
FIG. 4 is a fragmentary view similar to that of FIG. 2, with components thereof shown in an inoperative relationship.

Should a theft of any contents of the trunk be attempted in the known manner of first removing the lock cylinder assembly 12, with subsequent removal of the shaft 24 from the rectangular opening 56 of the cam member 54, it may be noted from FIG. 4 that the lever member 34 will have been urged by the hooked end 44 of the spring 38 into a clockwise direction, with an edge 96 (FIG. 4) of the lever member 34 abutting against the perpheral wall 27 of the housing 20. Thereafter, any insertion of a probe, or screwdriver, or other instrument into the rectangular opening 56 of the cam member 54 will rotate the cam surface 58 of the latter in the usual counterclockwise direction, as observed in FIG. 4, but without resulting in the usual contact with the cam surface 50 of the lever member 34 which has been rotated out of the path of the cam surface 58, as just explained. Thus, no operational contact may be made by the surface 86 of the lever member 34 with the extension 82 of the first latching lever 62. Thus, the latching portion 60 is prevented from being unlatched or tripped open.

Should a thief attempt to force the lock cylinder assembly 12 and/or the shaft 24 inward, rather than withdrawing same as discussed above, such inward force will cause the end of the shaft 24 adjacent the edge 30 thereof to bend the lever member 34 away from the wall 26 and out of the path of the cam member 54, thus once again eliminating the possibility of an unlatching operation to occur as a result of the insertion of a screwdriver or other instrument into the rectangular opening 56 of the cam member 54 and rotating same.

It should be apparent that the invention provides an improved trunk lid latching arrangement, which, while similar in some respects to the conventional arrangement of a lock cylinderactuated cam and associated latching components, includes an additional spring-loaded lever means mounted between the cam and adjacent latching components which have been spaced farther apart than in the usual arrangement. The additional lever means is operatively connected to a shaft extending from the lock cylinder assembly in such a manner that, should the shaft be removed from the latch assembly or forced inboard, the spring-loaded lever means would either snap into a position out of the path of the cam, or be bent out of the plane of the cam, thus eliminating the means through which the cam is able to remotely contact and unlatch a conventional set of latched levers.

While but one embodiment of the invention has been shown and described, other modifications thereof are possible.

I claim:

1. For use with an automotive trunk lid having a lock cylinder assembly mounted on an outer wall thereof, a latch assembly comprising a housing mounted on an inner wall of said trunk lid, a cam member rotatably mounted in said housing and having a rectangular opening formed therein, a shaft operatively extending from said lock cylinder assembly and through said rectangular opening for rotating said cam member in response to manual key actuation of said lock cylinder assembly, an abutment edge formed on the extended end of said shaft, first and second latching levers separately pivotally mounted in said housing, respective cooperative latching surfaces formed on said first and second latching levers, first spring means operatively connected between said first and second latching levers for retaining said latching surfaces together when in a latched condition and for urging said latching surfaces apart when in an unlatched condition, a camming lever having a cam surface and an abutment edge formed thereon and being pivotally mounted in said housing and adapted to have said cam surface positioned intermediate said cam member and said first latching lever, and second spring means urging said abutment edge of said camming lever into contact with said abutment edge of said shaft, said camming lever thereby being adapted to being pivoted away from said abutment edge of said shaft by said cam member against the force of said second spring means to sequentially pivot said first latching lever in response to rotation of said cam member by said lock cylinder assembly via said shaft, until such time as said lock cylinder assembly and said shaft are removed from said trunk lid after which said second coil spring will rotate said camming lever out of the path of said cam member, thereby preventing the unlatching of said latching levers from outside said trunk lid via rotation of said cam member.

2. For use with an automotive trunk lid having a lock cylinder assembly mounted on an outer wall thereof, a latch assembly comprising a housing mounted on an inner wall of said trunk lid, a cam member rotatably mounted in said housing and having a rectangular opening formed therein, a shaft operatively extending from said lock cylinder assembly and through said rectangular opening, first and second levers pivotally mounted on a first pivot pin secured to a wall of said housing, first spring means mounted on said first pivot pin and operatively connected between said first and second levers for urging said first and second levers in opposite rotational directions, said first lever being urged into contact with a surface of said shaft, a cam surface formed on said first lever for at times being engaged by said cam member, an extension formed on said second lever for being engaged by a surface of said first lever in response to camming action between said cam member and said cam surface, a third lever pivotally mounted on a second pivot pin secured to a wall of said housing, respective cooperating latching surfaces formed on said second and third levers, second spring means mounted on said second pivot pin and operatively connected between said second and third levers for urging said second and third levers apart once said latching surfaces are caused to separate in response to said camming action.

3. For use with an automotive trunk lid including a lock cylinder assembly mounted on an outer wall thereof, a latch assembly comprising a housing mounted on an inner wall of said trunk lid, a cam member rotatably mounted in said housing and having a rectangular opening formed therein, a shaft operatively extending from said lock cylinder assembly and through said rectangular opening, a camming lever and a first latching lever pivotally mounted on a first pivot pin secured to a wall of said housing, a first coil spring mounted on said first pivot pin and having the ends thereof extended and operatively connected between said camming lever and said first latching lever for urging said camming lever and said first latching lever in opposite rotational directions, a cam surface formed on said camming lever for at times being engaged by said cam member, an extension formed on said first latching lever for being engaged by a surface of said camming lever in response to camming action between said cam member and said cam surface, a second latching lever pivotally mounted on a second pivot pin secured to a wall of said housing, respective cooperating latching surfaces formed on said first and second latching levers, a second coil spring mounted on said second pivot pin and having the ends thereof extended and operatively connected between said first and second latching levers for urging said first and second latching levers apart once said latching surfaces are caused to separate in response to said camming action, a surface of said camming lever being urged by said first coil spring into contact with said shaft until such time as said lock cylinder assembly and said shaft are removed from said trunk lid after which said first coil spring will rotate said camming lever out of the path of said cam member thereby preventing the unlatching of said latching surfaces from outside said trunk lid via rotation of said cam member.

4. For use with an automotive trunk lid and a separate fixed striker member, a latching arrangment comprising a lock cylinder assembly mounted on an outer wall of said trunk lid and a latch assembly comprising a housing mounted on an inner wall of said trunk lid, said latch assembly including a cam member rotatably mounted in said housing and having a rectangular opening formed therein, a shaft operatively extending from said lock cylinder assembly and through said rectangular opening, a camming lever and a first latching lever pivotally mounted on a first pivot pin secured to a wall of said housing, a first coil spring mounted on said first pivot pin and having the ends thereof extended and bent to connect against respective edges of said camming lever and said first latching lever for urging said camming lever and said first latching lever in opposite rotational directions, a cam surface formed on said camming lever for at times being engaged by said cam member, an extension formed on said first latching lever for being engaged by a second surface of said camming lever in response to camming action between said cam member and said cam surface caused by manual rotation of said lock cylinder assembly and, hence, of said shaft, a second latching lever pivotally mounted on a second pivot pin secured to a wall of said housing, respective cooperating latching surfaces formed on said first and second latching levers, said latching surfaces being engaged upon rotation of said second latching lever upon contact by said fixed striker member during a manual closing operation of said trunk lid, a second coil spring mounted on said second pivot pin and having the ends thereof extended and bent to connect against respective edges of said first and second latching levers for urging said first and second latching levers apart once said latching surfaces are caused to separate in response to said camming action, a third surface of said camming lever being urged by said first coil spring into contact with and retained against said shaft prior to any manually-actuated camming action and until such time as said lock cylinder assembly and said shaft are removed from said trunk lid, permitting said first coil spring to rotate said camming lever out of the path of said cam member thereby preventing the unlatching of said latching surfaces from outside said trunk lid via rotation of said cam member.

* * * * *